US008056152B2

(12) United States Patent
Brace

(10) Patent No.: US 8,056,152 B2
(45) Date of Patent: Nov. 15, 2011

(54) PIVOT ASSEMBLY FOR HEADGEAR

(75) Inventor: Thomas J. Brace, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/935,758

(22) PCT Filed: Mar. 25, 2009

(86) PCT No.: PCT/US2009/038155

§ 371 (c)(1),
(2), (4) Date: Sep. 30, 2010

(87) PCT Pub. No.: WO2009/137177

PCT Pub. Date: Nov. 12, 2009

(65) Prior Publication Data

US 2011/0023204 A1 Feb. 3, 2011

Related U.S. Application Data

(60) Provisional application No. 61/042,129, filed on Apr. 3, 2008.

(51) Int. Cl.

| | |
|---|---|
| ***A42B 1/08*** | (2006.01) |
| ***A42B 1/06*** | (2006.01) |
| ***A42B 1/24*** | (2006.01) |
| ***A61F 9/06*** | (2006.01) |

(52) U.S. Cl. ..... 2/424; 2/410; 2/8.2; 2/422

(58) Field of Classification Search ..... 2/410, 5, 2/6.1, 6.2, 6.3, 6.5, 6.6, 6.7, 8.1, 8.2, 422, 2/423, 424, 425, 15, 10, 13, 426, 427, 428, 2/429, 9, 171, 206, 209.13; D29/102, 103, D29/104, 105, 106, 107, 108, 109, 110, 111
See application file for complete search history.

(56) References Cited

U.S. PATENT DOCUMENTS 3,037,236 A 6/1962 Miller
(Continued)

FOREIGN PATENT DOCUMENTS

| | | |
|---|---|---|
| CA | 2 349 764 | 11/2001 |
| CA | 2 422 406 | 9/2003 |
| CA | 2 520 542 | 10/2004 |
| CN | 1795362 | 6/2006 |

(Continued)

OTHER PUBLICATIONS

International Search Report PCT/US2009/038155 Dec. 2, 2009; 3 pgs.

*Primary Examiner* — Gary L Welch
*Assistant Examiner* — Jane Yoon
(74) *Attorney, Agent, or Firm* — Nicole J. Einerson

(57) ABSTRACT

A pivot assembly for use with headgear that includes a headtop and a shield, and a method for coupling the headtop to the shield using the pivot assembly. The pivot assembly can include a housing, a socket dimensioned to be received in the housing and having a plurality of first engagement features, and a post having a plurality of second engagement features adapted to engage the first engagement features. The pivot assembly can further include a spring dimensioned to be received in the housing to bias the first engagement features and the second engagement features into engagement, while allowing relative rotation between the post and the socket. A method can include moving the socket in a first direction into the housing, moving the post in a second direction that is different from the first direction toward engagement with the socket, and moving the spring in the first direction into the housing.

20 Claims, 5 Drawing Sheets

U.S. PATENT DOCUMENTS

| | | | | | |
|---|---|---|---|---|---|
| 3,074,072 | A | * | 1/1963 | Zahnor et al. | 2/8.1 |
| 3,608,935 | A | | 9/1971 | Hodapp, Jr. | |
| 3,631,540 | A | | 1/1972 | Penny | |
| 3,945,043 | A | | 3/1976 | DeAngelis | |
| 4,040,123 | A | | 8/1977 | Williams | |
| 4,109,320 | A | * | 8/1978 | Anderson | 2/10 |
| 4,170,792 | A | | 10/1979 | Higgs | |
| 4,199,823 | A | | 4/1980 | Jenkins et al. | |
| 4,332,004 | A | | 5/1982 | Slaughter | |
| 4,422,185 | A | | 12/1983 | Cook | |
| 4,549,541 | A | | 10/1985 | Sundahl | |
| 4,718,127 | A | | 1/1988 | Rittmann et al. | |
| 4,766,609 | A | | 8/1988 | Lane | |
| 4,937,879 | A | | 7/1990 | Hall et al. | |
| 5,012,528 | A | * | 5/1991 | Pernicka et al. | 2/10 |
| 5,084,918 | A | | 2/1992 | Breining et al. | |
| 5,091,997 | A | * | 3/1992 | Foehl | 2/424 |
| 5,177,816 | A | | 1/1993 | Schmidt et al. | |
| 5,461,731 | A | * | 10/1995 | Shida | 2/424 |
| 5,475,878 | A | | 12/1995 | Dawn et al. | |
| 5,784,724 | A | | 7/1998 | Liang | |
| 5,819,318 | A | * | 10/1998 | Tse | 2/182.1 |
| 5,966,738 | A | * | 10/1999 | Wang Lee | 2/10 |
| 6,009,561 | A | * | 1/2000 | Bullock et al. | 2/422 |
| 6,035,451 | A | * | 3/2000 | Burns et al. | 2/424 |
| 6,041,435 | A | * | 3/2000 | Paulson et al. | 2/10 |
| 6,173,447 | B1 | | 1/2001 | Arnold | |
| 6,298,498 | B1 | | 10/2001 | Burns et al. | |
| 6,438,763 | B2 | | 8/2002 | Guay et al. | |
| 6,442,767 | B1 | | 9/2002 | Meckes et al. | |
| 7,231,698 | B2 | * | 6/2007 | Downing et al. | 24/628 |
| 2001/0039671 | A1 | | 11/2001 | Robinson et al. | |
| 2003/0110548 | A1 | | 6/2003 | Robinson et al. | |
| 2003/0182716 | A1 | | 10/2003 | Wu | |
| 2004/0199982 | A1 | * | 10/2004 | Wang-Lee | 2/424 |
| 2006/0080761 | A1 | * | 4/2006 | Huh | 2/424 |
| 2007/0124852 | A1 | | 6/2007 | Pyo | |
| 2008/0216215 | A1 | * | 9/2008 | Lee | 2/424 |
| 2009/0038057 | A1 | * | 2/2009 | Tews | 2/424 |
| 2009/0044317 | A1 | * | 2/2009 | Tews | 2/424 |
| 2009/0126086 | A1 | * | 5/2009 | Taccioli et al. | 2/424 |
| 2009/0300813 | A1 | * | 12/2009 | Ishikawa | 2/15 |
| 2010/0064406 | A1 | * | 3/2010 | Lee | 2/10 |

FOREIGN PATENT DOCUMENTS

| | | |
|---|---|---|
| DE | 44 17 658 | 11/1995 |
| DE | 296 13 254 | 11/1996 |
| DE | 100 40 509 | 3/2002 |
| FR | 2 637 808 | 4/1990 |
| FR | 2 767 264 | 2/1999 |
| GB | 2 024 927 | 1/1980 |
| GB | 2 119 229 | 11/1983 |
| GB | 2 399 759 | 9/2004 |
| JP | 06-076335 U | 10/1994 |
| KR | 10-2001-0041780 | 5/2001 |
| WO | WO 94/27179 | 11/1994 |
| WO | WO 2004/040227 | 5/2004 |

* cited by examiner

PIVOT ASSEMBLY FOR HEADGEAR

CROSS REFERENCE TO RELATED APPLICATIONS

This is a national stage filing under 35 U.S.C. 371 of PCT/US2009/038155, filed Mar. 25, 2009, which claims priority to U.S. Provisional Application No. 61/042,129, filed Apr. 3, 2008, the disclosure of which is incorporated by reference in its entirety herein.

FIELD

The present disclosure generally relates to a pivot assembly for use with headgear, and particularly, for use with headgear having a headtop portion and an eye- or face-covering portion that is movable relative to the headtop portion.

BACKGROUND

Headgear is used in a variety of applications to provide covering and/or protection to a user's head. Some headgear includes a visor or a faceshield that is pivotally movable with respect to a headtop between an open and closed position. Such headgear may further include one or more components that function as a pivot mechanism to attempt to control the movement of the visor or faceshield between the open and closed positions. Such controlled movement can allow the visor or faceshield to be maintained in the open or closed position, or in a position intermediate of the open and closed positions. Some pivot mechanisms include detent-type hinge mechanisms, threaded engagements, or mechanisms that require the use of external tools for assembly or disassembly. In addition, some pivot mechanisms include components that can be coupled together in a variety of ways, and components that are unique to either the left side or the right side of the headgear. Furthermore, some pivot mechanisms require additional locking means in order to maintain the visor or faceshield in a desired position.

SUMMARY

Some embodiments of the present disclosure provide a pivot assembly for headgear comprising a headtop and a shield. The pivot assembly can include a housing adapted to be coupled to the headtop, the housing having an interior. The pivot assembly can further include a socket dimensioned to be received in the interior of the housing, the socket including a plurality of first engagement features, and a post adapted to be coupled to the shield, the post including a plurality of second engagement features adapted to engage the plurality of first engagement features. At least a portion of the post can be dimensioned to be received in the interior of the housing. The pivot assembly can further include a spring dimensioned to be received in the interior of the housing to engage the post and to bias the plurality of second engagement features into engagement with the plurality of first engagement features while allowing relative rotation between the post and the socket.

Some embodiments of the present disclosure provide a pivot assembly for headgear that comprises a headtop and a shield. The pivot assembly can include a housing adapted to be coupled to the headtop. The housing can include an interior, a first aperture positioned to provide access to the interior along a first direction, and a second aperture positioned to provide access to the interior of the housing along a second direction, the second direction being oriented at an angle with respect to the first direction. The pivot assembly can further include a socket dimensioned to be received in the interior of the housing via the first aperture, the socket including a plurality of first engagement features, and a post adapted to be coupled to the shield, the post including a plurality of second engagement features adapted to engage the plurality of first engagement features. At least one of the plurality of first engagement features and the plurality of second engagement features can include at least one cam surface configured to allow relative rotational movement between the socket and the post. At least a portion of the post can be dimensioned to be received in the interior of the housing via the second aperture. The pivot assembly can further include a spring dimensioned to be received in the interior via the first aperture of the housing to engage the post. The spring can be configured to provide a biasing force substantially along the second direction to bias the second plurality of engagement features into engagement with the first plurality of engagement features while allowing relative rotation between the post and the socket.

Some embodiments of the present disclosure provide a headgear comprising a headtop, a shield, and a pivot assembly adapted to couple the headtop and the shield, such that the shield is pivotally movable relative to the headtop between an open position and a closed position. The pivot assembly can include a housing coupled to the headtop. The housing can include an interior, a first aperture positioned to provide access to the interior along a first direction, and a second aperture positioned to provide access to the interior of the housing along a second direction, the second direction being different from the first direction. The pivot assembly can further include a socket dimensioned to be received within the interior of the housing via the first aperture of the housing, the socket having a plurality of first engagement features, and a post coupled to the shield, the post having a plurality of second engagement features adapted to engage the plurality of first engagement features of the socket. At least a portion of the post can be dimensioned to be received in the interior of the housing via the second aperture of the housing. The pivot assembly can further include a spring dimensioned to be received within the interior of the housing via the first aperture of the housing. The spring can be adapted to: (i) engage the post, (ii) bias the plurality of second engagement features into engagement with the plurality of first engagement features, and (iii) engage the housing to reversibly lock the pivot assembly in an assembled state.

Some embodiments of the present disclosure provide a method for coupling a shield of a headgear to a headtop of the headgear to allow relative rotation between the shield and the headtop. The method can include providing a housing comprising an interior. The housing can be coupled to the headtop of the headgear. The method can further include moving a socket in a first direction into the interior of the housing. The socket can include a plurality of first engagement features. The method can further include providing a post having a plurality of second engagement features adapted to engage the plurality of first engagement features. The post can be coupled to the shield of the headgear. The method can further include moving the post in a second direction toward engagement with the socket, the second direction being different from the first direction. The method can further include moving a spring in the first direction into the interior of the housing and into engagement with at least a portion of the post. The spring can be adapted to bias the plurality of first engagement features and the plurality of second engagement features into engagement while allowing relative rotational movement between the post and the socket.

Other features and aspects of the present disclosure will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "connected," "supported," and "coupled" and variations thereof are used broadly and encompass both direct and indirect connections, supports, and couplings. Further, "connected" and "coupled" are not restricted to physical or mechanical connections or couplings. It is to be understood that other embodiments may be utilized, and structural or logical changes may be made without departing from the scope of the present disclosure. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

The present disclosure generally relates to a pivot assembly for use with headgear, and particularly, for use with headgear having a headtop portion and an eye- or face-covering portion (e.g., a shield) that is movable relative to the headtop portion. The pivot assembly of the present disclosure provides a slim, low-profile, easy-to-install apparatus for coupling the headtop portion to the eye- or face-covering portion, while still allowing relative movement between the headtop portion and the eye- or face-covering portion.

Figure 1:
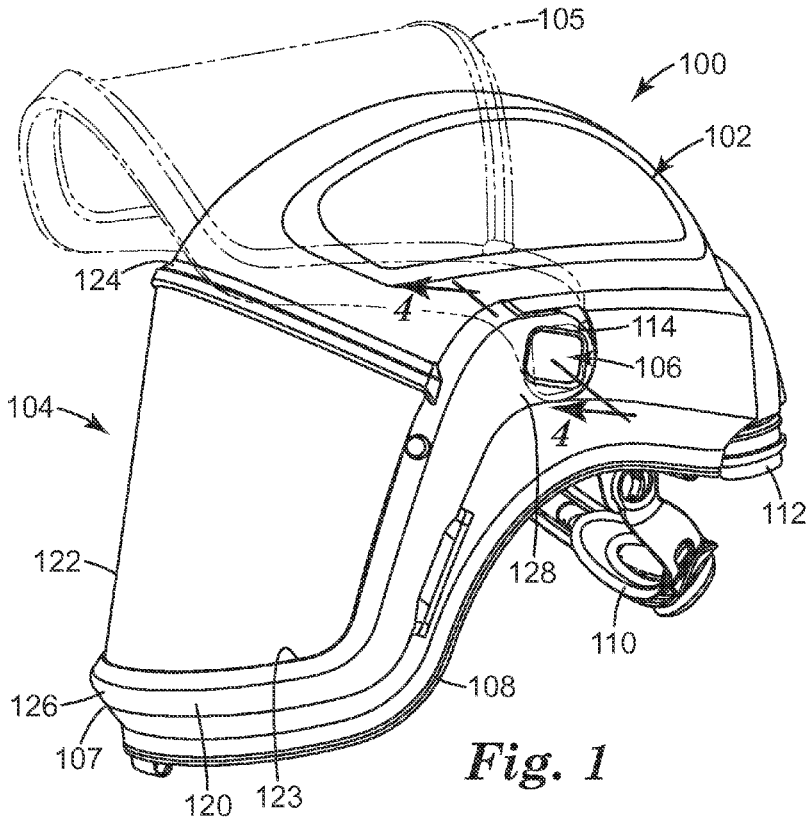
FIG. 1 is a perspective view of a headgear according to one embodiment of the present disclosure, the headgear including a headtop, a shield, and two pivot assemblies (one pivot assembly shown).

FIGS. 1-6 illustrate a headgear 100 according to one embodiment of the present disclosure. As shown in FIG. 1, the headgear 100 includes a headtop 102, a shield 104, and a pivot assembly 106 that allows for relative rotational movement between the headtop 102 and the shield 104. As further shown in FIG. 1, the shield 104 is pivotally movable with respect to the headtop 102 between an up, or open, position 105, and a down, or closed, position 107. The open position 105 illustrated in phantom lines in FIG. 1 is shown as an example of one possible open position. However, it should be understood that a variety of other positions beyond the illustrated open position 105 and intermediate of the illustrated open position 105 and the closed position 107 are possible and within the scope of the present disclosure. The shield 104 can be removably coupled to the headtop 102.

The headtop 102 is shaped and dimensioned to fit over the top of a user's head to provide cover, means for attaching the shield 104, and/or protection (e.g., impact and/or environmental protection) to a user's head. The headtop 102 can be formed of a variety of materials, including, but not limited to, at least one of metal (e.g., aluminum, etc.), polymeric materials (e.g., high density polyethylene (HDPE); acrylonitrile-butadiene-styrene (ABS); polycarbonate; NYLON® polyamide, e.g., from E. I. du Pont de Nemours and Company, Wilmington, Del.; etc.), composite materials (e.g., fiber reinforced NYLON® polyamide, fiber reinforced polyester), other suitable materials, and combinations thereof. In addition, the headtop 102 can take on a variety of forms depending on the desired uses. For example, in some embodiments, the headtop 102 can be a simple bump cap, a hard hat, a helmet, and combinations thereof.

Figure 3:
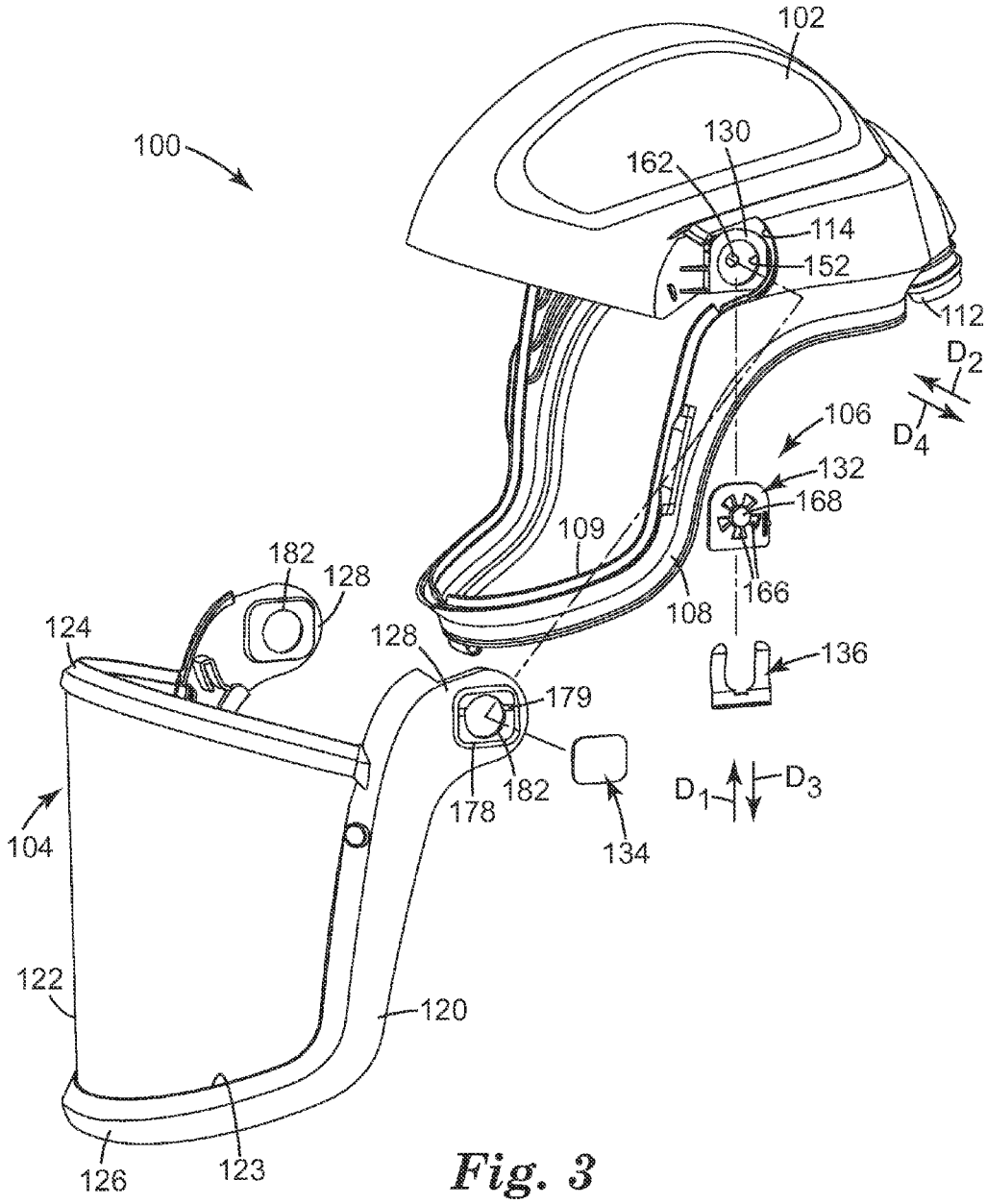
FIG. 3 is a top exploded perspective view of the headgear of FIGS. 1 and 2, with only one pivot assembly shown for clarity.

In some embodiments, as shown in FIGS. 1 and 3, the headgear 100 can further include a jaw piece 108 that is coupled to, or forms a portion of, the headtop 102 to provide further cover, additional coupling means for the shield 104, and/or protection to a user's face. In embodiments employing the jaw piece 108, the jaw piece 108 can be rigidly coupled to the headtop 102, and the jaw piece 108 can provide registration and sealing surfaces for various portions of the shield 104. In embodiments employing a jaw piece 108, the jaw piece 108 and the headtop 102 define a first viewing window, or opening, 109 (see FIG. 3), such that when the shield 104 moves into its closed position 107, the shield 104 is positioned across the first viewing window 109.

In some embodiments, the headgear 100 can further include a strap, or harness, 110 that is coupled to, or forms a portion of, the headtop 102 to provide means for securing the headgear 100 to a user's head. The strap 110 has been removed from FIG. 3 for clarity.

In the illustrated embodiment, the headtop 102 is adapted to provide cover to a user's head, and the strap 110 is adapted to couple the headgear 100 to the user's head. However, in some embodiments, the headtop 102 is substantially formed of the strap 110, such that the primary purpose of the headtop 102 is to couple the shield 104 (or other components of the headgear 100) to a user's head, and doesn't necessarily provide cover to the user's head.

In some embodiments, as shown in FIG. 1, the headgear 100 is configured for use in respirator systems, and further includes a port 112 (see FIGS. 1 and 3) coupled to the headtop 102 to allow connection to a source of clean (e.g., filtered) air (not shown). In such embodiments, at least a portion of the headgear 100 (e.g., the headtop 102, the shield 104 and the jaw piece 108, if employed) can form an enclosure around the user's face that separates a user's interior gas space from the surrounding exterior gas space. A user's breathing zone can be located between the enclosure and the user's face. Clean air can be provided into the breathing zone from any suitable source of clean air. The user can breathe the air and exhale it back into the breathing zone. This exhaled air, along with excess clean air that is moved into the breathing zone, may exit the breathing zone via one or more openings in the enclosure (e.g., around the edges of the shield 104) or through any other suitable route. For the purposes of the present disclosure, the phrase "clean air" refers to atmospheric ambient air that has been filtered or air supplied from an independent source. The phrase "clean air source" refers to an apparatus, such as a filtering unit or a tank that is capable of providing a supply of clean air (or oxygen) for the user of the respirator system.

The port 112 can be coupled to the headtop 102, or can form a portion of the headtop 102, such that the port 112 is in fluid communication with the enclosure of the headgear 100 and a user's nose and/or mouth. The port 112 can be coupled to an air supply system. The air supply system, whether a positive pressure system or a negative pressure system, can assist in maintaining a net flow of gas out of the enclosure to reduce the chance that contaminants will enter the enclosure.

In embodiments in which the headgear 100 is configured for use in a respirator system, the respirator system can include, or be coupled to, a clean air supply system (not shown) which can include an inlet configured for connection to a source of clean air and an outlet positioned in fluid communication with the breathing zone. In some embodiments, the source of clean air can be an air exchange apparatus, which can include an apparatus for providing a finite breathing zone volume around the head of a user in which air can be exchanged in conjunction with the user's breathing cycle.

One example of a respirator system employing an air exchange apparatus is a Powered Air Purifying Respirator" (PAPR), which is a powered system having a blower to force ambient air through air-purifying elements to an inlet of a clean air supply system. However, the present disclosure is not limited to such systems and may include any other suitable air supply system, including but not limited to negative pressure systems. Other exemplary air supply systems may include, without limitation, any suitable supplied air system or a compressed air system, such as a self contained breathing apparatus (SCBA).

In the illustrated embodiment, the shield 104 includes a frame 120 that is coupled to the headtop 102 via the pivot assembly 106. The frame 120 can be shaped to provide cover and/or protection to at least a portion of a user's head. For example, in some embodiments, the shield 104 can include a visor that covers a user's eyes, and in some embodiments, as shown in FIGS. 1 and 3, the shield 104 can include a full face shield. The shield 104 can be sized and shaped to provide any level of cover or protection desired, depending on the intended use of the headgear 100. The shield 104 can further include a lens 122 through which the user can see, and a seal 124, which allows the shield 104 to seal against a surface of the headtop 102, and which can be involved in forming an enclosure around a user's face. In some embodiments, the shield 104 can be formed substantially of the lens 122, and the lens 122 can be coupled to the headtop 102 via the pivot assembly 106.

The shield frame 120 can be formed of a variety of materials, including, but not limited to, the materials listed above with respect to the headtop 102. The lens 122 can be formed of a variety of materials, including, but not limited to, glass, polymeric materials (e.g., polycarbonate, acetate, NYLON® polyamide, acrylic, etc.), other suitable lens materials, and combinations thereof.

The frame 120 of the shield 104 at least partially defines a viewing window, or opening, 123 (e.g., a second viewing window 123 in embodiments that employ a jawpiece 108 that defines a first viewing window 109). The lens 122 can be removably coupled to the frame 120 across the viewing window 123 to provide additional cover or protection to a user's eyes or face, and to contribute to forming an enclosure around at least a portion of a user's face (e.g., in respiratory applications).

Figure 2:
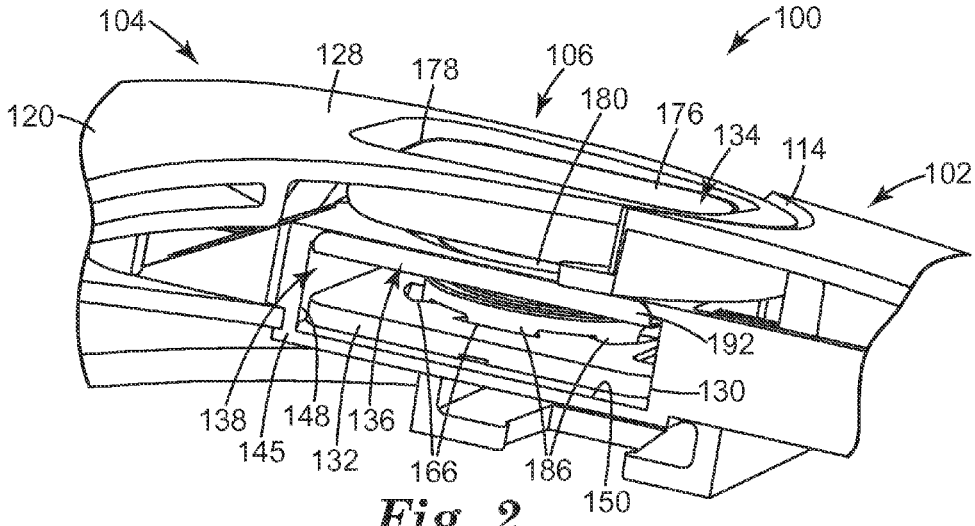
FIG. 2 is a bottom perspective view of the headgear of FIG. 1.

The frame 120 of the shield 104 shown in FIGS. 1-4 is generally U-shaped and includes a lower portion 126 and two upper portions 128 that extend upwardly from the lower portion 126 to be coupled to either side of the headtop 102 via the pivot assembly 106. FIG. 2 illustrates a close-up bottom view of the left side of the headgear 100 where the left upper portion 128 of the frame 120 of the shield 104 is coupled to the headtop 102 by the pivot assembly 106. In some embodiments, as shown in FIGS. 1-3, the headtop 102 includes a recess 114 on each side that is shaped and dimensioned to receive an upper portion 128 of the shield frame 120, which can create a flush side profile on either side of the headgear 100, while allowing relative rotation between the shield 104 and the headtop 102. The shape and overall appearance of the frame 120 of the shield 104 of the illustrated embodiment is shown by way of example only, but it should be understood that other shapes and structures of the shield 104 or shield frame 120 are possible and within the scope of the present disclosure.

Figure 4:
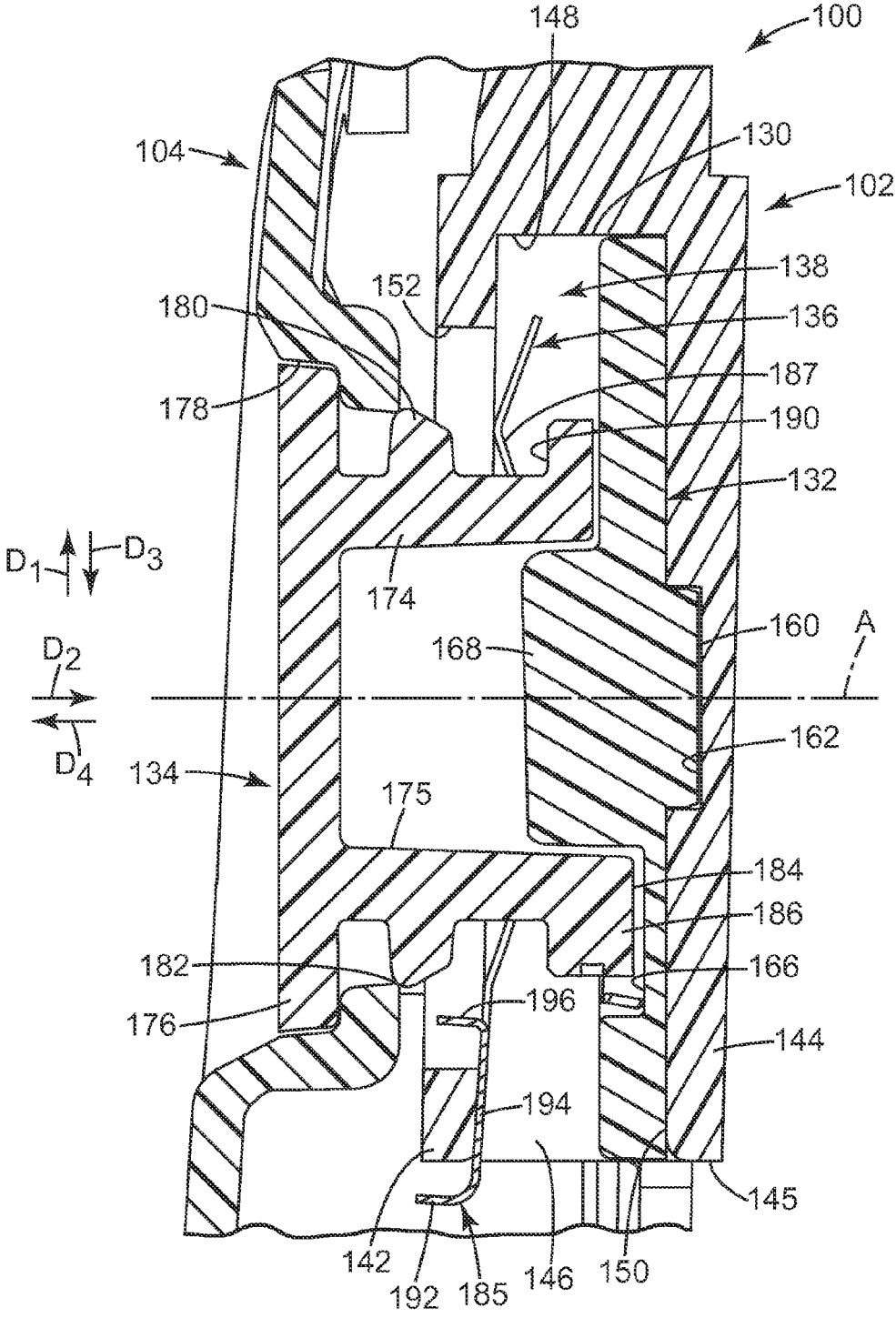
FIG. 4 is a side cross-sectional view of the headgear of FIGS. 1-3, taken along line 4-4 of FIG. 1.
Figure 5:
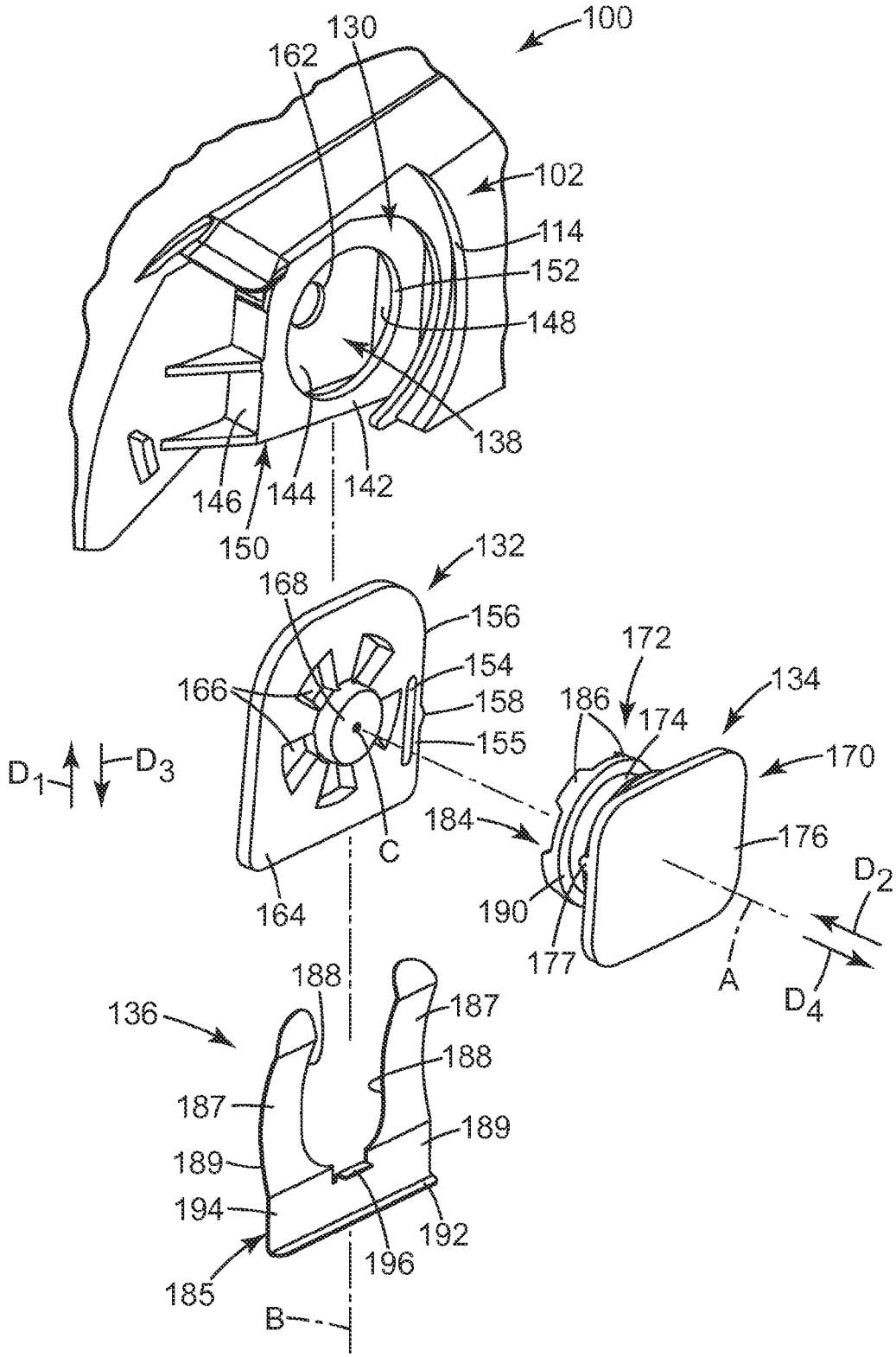
FIG. 5 is a front close-up exploded perspective view of the headtop and pivot assembly of FIGS. 1-4.
Figure 6:
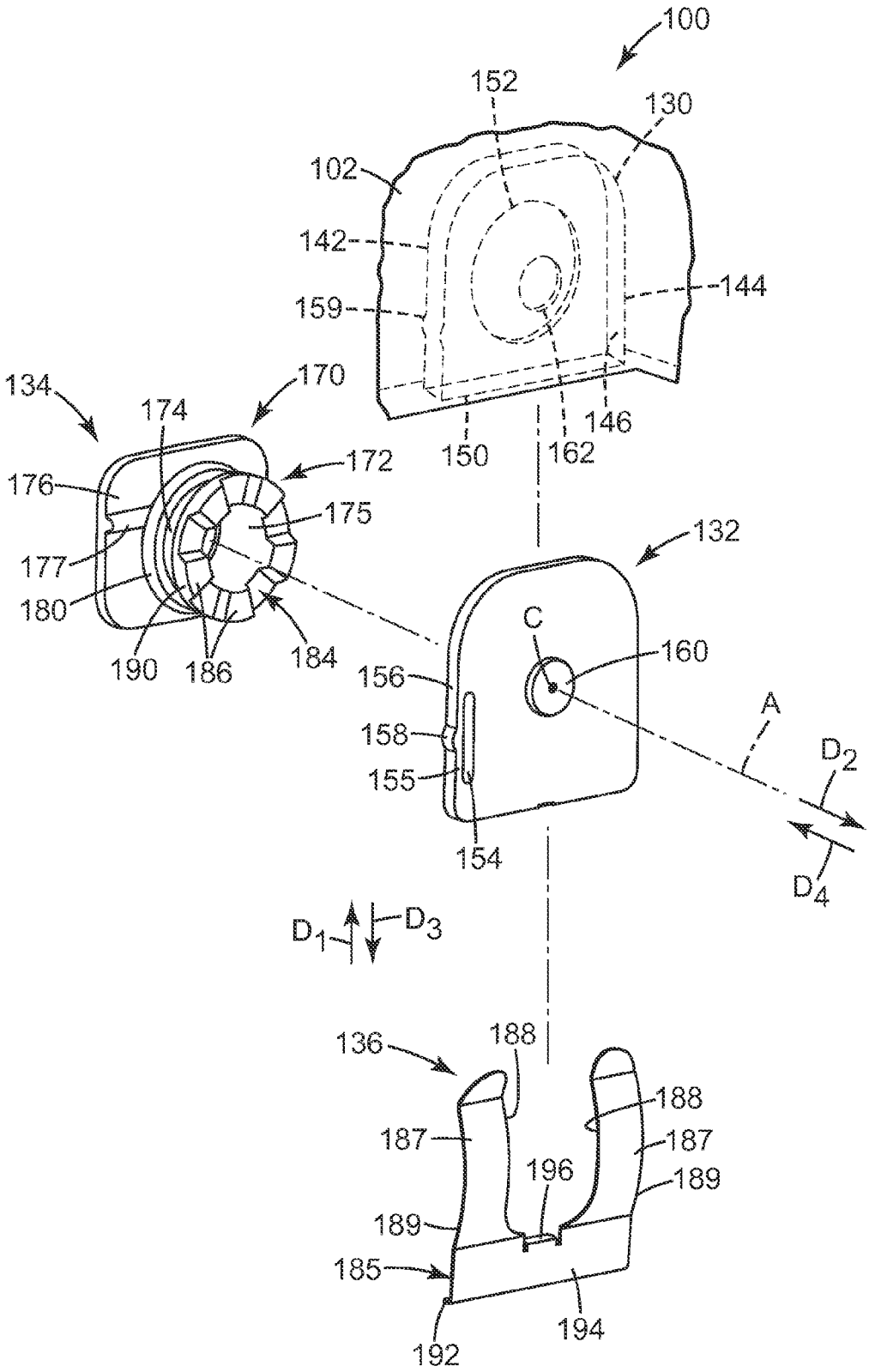
FIG. 6 is a rear close-up exploded perspective view of the headtop and pivot assembly of FIGS. 1-5.

FIGS. 2-6 illustrate the pivot assembly 106 in greater detail. FIGS. 2-4 illustrate how the components of the pivot assembly 106 are coupled to one another, as well as to the headtop 102 and the shield 104. FIGS. 5 and 6 illustrate the components of the pivot assembly 106 in detail, with the shield 104 removed for clarity. As shown in FIGS. 2-6, the pivot assembly 106 includes a housing 130, a socket 132, a post 134, and a spring 136.

The housing 130 can be coupled to the headtop 102 via a variety of removable, semi-permanent, or permanent coupling means, described below. For example, in the embodiment illustrated in FIGS. 1-6, the housing 130 is integrally formed in the headtop 102, such that the housing 130 is permanently coupled to the headtop 102, and the headtop 102 includes the housing 130 of the pivot assembly 106. However, in some embodiments, the housing 130 is formed separately from the headtop 102 and removably or semi-permanently coupled to the headtop 102. As a result, when the housing 130 is described as being "coupled" to the headtop 102 or "adapted to be coupled" to the headtop 102, this coupling can include removable, semi-permanent and permanent types of coupling, and combinations thereof.

Removable coupling means can include, but are not limited to, gravity (e.g., one component can be set atop another component, or a mating portion thereof), screw threads, press-fit engagement (also sometimes referred to as "friction-fit engagement" or "interference-fit engagement"), snap-fit engagement, magnets, hook-and-loop fasteners, adhesives, cohesives, clamps, heat sealing, other suitable removable coupling means, and combinations thereof. Permanent or semi-permanent coupling means can include, but are not limited to, adhesives, cohesives, stitches, staples, screws, nails, rivets, brads, crimps, welding (e.g., sonic (e.g., ultrasonic) welding), any thermal bonding technique (e.g., heat and/or pressure applied to one or both of the components to be coupled), snap-fit engagement, press-fit engagement, heat sealing, other suitable permanent or semi-permanent coupling means, and combinations thereof. One of ordinary skill in the art will recognize that some of the permanent or semi-permanent coupling means can also be adapted to be removable, and vice versa, and are categorized in this way by way of example only.

The exemplary housing 130 shown in FIGS. 2-6 generally has the shape of a rectangular prism, or cuboid, with the upper two corners being rounded, and includes a front wall 142, a rear wall 144, a bottom wall 145 (see FIGS. 2 and 4), and a side wall 146 (see FIGS. 4-6) that joins the front and rear walls 142, 144 and forms the sides and top of the housing 130. The walls 142, 144, 145, 146 of the housing 130 define a hollow interior 138 and an inner surface 148. The housing 130 further includes a slot, or first aperture, 150 in the bottom wall 145 that provides access to the interior 138 in a first direction $D_1$, and a second aperture 152 in the front wall 142 that provides access to the interior 138 in a second direction $D_2$, which is different from the first direction (e.g., oriented at an angle with respect to the first direction $D_1$). In some embodiments, such as the illustrated embodiment, the second direction $D_2$ is oriented substantially perpendicularly with respect to the first direction $D_1$.

As shown in FIG. 2, the housing 130 is oriented with respect to the headtop 102 such that the bottom slot 150 faces downwardly when the headgear 100 is positioned atop a user's head. As a result, the second aperture 152 faces outwardly to the side when the headgear 100 is atop a user's head. For simplicity, the orientation terms used herein with respect to the pivot assembly 106 will follow the orientation of FIGS. 5 and 6, with FIG. 5 representing the "front" view and FIG. 6 representing the "rear" view. Accordingly, the terms "front," "forward," "in front of," and variations thereof, refer to portions of an element that are positioned away from the midline (i.e., toward the side) of the headgear 100, or movement in that direction, and the terms "rear," "rearward," "behind," and variations thereof, refer to portions of an element that are positioned toward the midline (i.e., toward the center) of the headgear 100, or movement in that direction. Other terms of orientation, such as "top," "upper," "bottom," and "lower," are used to refer to elements or movement toward the top of the headgear 100 and the bottom of the headgear 100, respectively.

The bottom slot 150 has a generally rectangular cross-sectional shape, and the second aperture 152 has a generally circular cross-sectional shape. In the illustrated embodiment, the first and second apertures 150 and 152 are shaped to accommodate other components of the pivot assembly 106 and to encourage relative rotation about a central axis A (see FIGS. 4-6); however, it should be understood that other shapes are possible, as long as the aperture shapes provide adequate coupling and cooperation with the other components of the pivot assembly 106.

The socket 132 is shaped and dimensioned to be received in the interior 138 of the housing 130. Particularly, the socket 132 is configured to be slid in the first direction $D_1$ into the housing 130 via the bottom slot 150. The socket 132 can be coupled to the housing 130 via any of the above-described coupling means. That is, the socket 132 can include a variety of coupling or orienting features and/or textures to encourage proper and facile positioning of the socket 132 within the housing 130.

For example, as shown in FIGS. 5 and 6, the socket 132 of the illustrated embodiment includes a slot, or aperture, 154 formed through the socket 132 near a side wall of the socket 132, forming a resilient member such as a flexible and thin wall 155 in the side of the socket 132. The resilient member, here, the thin wall 155, can flex inwardly as the socket 132 is slid into the housing 130 to allow a tighter interference fit between at least a portion of an outer surface 156 of the socket 132 and the inner surface 148 of the housing 130, and to inhibit relative movement between the socket 132 and the housing 130. However, it should be understood that the thin wall 155 is only one example of a resilient member that can be employed to facilitate coupling the socket 132 to the housing 130 and to inhibit relative movement between the socket 132 and the housing 130, but that other suitable resilient and/or movable members can be employed to accomplish such functions. Examples of other resilient members can include, but are not limited to, a resilient or elastomeric material positioned on at least one of the outer surface 156 of the socket 132 and the inner surface 148 of the housing 130; one or more cam surfaces positioned on at least one of the outer surface 156 of the socket 132 and the inner surface 148 of the housing 130; other suitable resilient or movable members; and combinations thereof.

As shown in FIGS. 5 and 6, in some embodiments, the thin wall 155 can further include an outwardly-projecting protrusion 158 that can cam along the inner surface 148 of the housing 130 as the socket 132 is moved into the interior 138 of the housing 130, and which can provide an interference fit between the socket 132 and the inner surface 148 of the housing 130. In addition, in some embodiments, as shown in FIGS. 5 and 6, the housing can include a correspondingly-shaped recess 159 formed in the side wall 146 of the housing 130 that is dimensioned to receive the protrusion 158, such that the protrusion 158 can move into engagement (e.g., snap) with the recess 159 of the housing 130 as the socket 132 is slid into the housing 130. Such coupling and orientation features between the socket 132 and the housing 130 can enhance the engagement between the socket 132 and the housing 130, and can further function as orientation guides to allow facile assembly in one orientation. However, some embodiments of the pivot assembly 106 do not include such coupling and orientation features between the socket 132 and the housing 130.

As illustrated in FIGS. 5 and 6, the socket 132 can further include at least one socket locating feature, such as a rearwardly-projecting protrusion 160 that is shaped and dimensioned to engage or mate with at least one corresponding housing locating feature, such as a recess 162 formed in the inner surface 148 of the rear wall 144 of the housing 130. The engagement of the protrusion 160 of the socket 132 and the recess 162 of the housing 130 can serve to stabilize the socket 132 with respect to the housing 130 in a desired spatial arrangement and can inhibit removal of the socket 132 from the housing 130. The protrusion 160 and recess 162 are shown by way of example only, but one of ordinary skill in the art should understand that the protrusion 160 can instead be located on the housing 130 and the recess 162 can be located on the socket 132, a plurality of such features can be included, and/or a variety of other shapes and sizes of locating features could be used to encourage coupling of the socket 132 and the housing 130.

The socket 132 includes a front surface 164 and one or more engagement features 166 that form at least a portion of the front surface 164, and which are configured to engage the post 134, as will be described in greater detail below. The phrase "engagement feature" is used to generally refer to a protrusion or recess that is shaped to cooperate with one or more similarly shaped and sized recesses or protrusions, respectively, to provide coupling between two components. In the embodiment shown in FIGS. 1-6, the engagement features 166 include five equally-spaced, recesses that are arranged in a windmill pattern (i.e., circumferentially) about a center point C, each recess having generally a frusto-sector shape and having arcuate top and bottom surfaces. As shown in FIGS. 3-5, the socket 132 can further include a coupling or orientation feature, such as a shaft 168 that is centered about the same center point C as the engagement features 166, and which extends outwardly from the front surface 164 of the socket 132 to further engage the post 134, as will be described in greater detail below.

In the illustrated embodiment, when the socket 132 is positioned within the housing 130, the second aperture 152 of the housing 130 is concentric with the engagement features 166 and the shaft 168. As a result, when the pivot assembly 106 is assembled, the engagement features 166 and the shaft 168 of the socket 132 are positioned co-axially with respect to the second aperture 152 of the housing 130 about the axis A, which forms the rotational axis of the pivot assembly 106. However, it should be understood that such an arrangement is shown by way of example only, and that some embodiments do not include such concentricity between the second aperture 152 of the housing 130 and the socket 132.

The post 134 of the pivot assembly 106 includes a front (or an outer) portion 170 that couples to the shield 104, and a rear (or an inner) portion 172 that couples to the socket 132. The post 134 can be coupled to the shield 104 via a variety of removable, semi-permanent, or permanent coupling means, such as those described above. For example, in the embodiment illustrated in FIGS. 1-6 and described below, the post 134 is removably coupled to the shield 104. However, this embodiment is shown and described by way of example only, and it should be understood that in some embodiments, the post 134 can be semi-permanently or permanently coupled to the shield 104. For example, in some embodiments, the post 134 (e.g., the front portion 170 of the post 134) can be integrally formed with the shield 104, such that the shield 104 includes the post 134. As a result, when the post 134 is described as being "coupled" to the shield 104 or "adapted to be coupled" to the shield 104, this coupling can include removable, semi-permanent and permanent types of coupling, and combinations thereof.

With continued reference to the illustrated embodiment, the front portion 170 is joined with the rear portion 172 by a generally cylindrical shaft 174 that is configured to rotate about the axis A when the pivot assembly 106 is assembled. As shown in FIG. 6, the shaft 174 includes a bore 175 that is dimensioned to receive the shaft 168 of the socket 132 to further enhance the coupling and cooperation between the post 134 and the socket 132. It should be understood, however, that in some embodiments, the post 134 can include the shaft 168 and the socket 132 can include the bore 175. It should be further understood that, in some embodiments, such additional means of coupling and aligning the post 134 and the socket 132 are not present at all.

In the illustrated embodiment, the front portion 170 of the post 134 includes a first flange 176 that extends laterally outwardly from the shaft 174 and which is shaped and dimensioned to be received in a pocket 178 formed in the frame 120 of the shield 104 (see FIGS. 2-4). In the illustrated embodiment, the flange 176 has a generally rectangular shape with rounded corners, and forms the portion of the pivot assembly 106 that can be seen when the assembled headgear 100 is viewed from the side. The generally rectangular shape of the flange 176 allows the flange 176 to be coupled to the shield 104 for rotation therewith, such that when the shield 104 is rotated relative to the headtop 102, the flange 176 is inhibited from rotating relative to the shield 104. However, it should be understood the flange 176 can take on a variety of other suitable shapes.

As shown in the illustrated embodiment, the rear-facing surface of the flange 176 can include a rib 177 that extends laterally outwardly from the shaft 174, and which has its length oriented laterally. The rib 177 provides an orientation feature on the post 134 that is shaped and dimensioned to be received in a correspondingly shaped recess 179 (see FIG. 3) of the pocket 178 of the shield frame 120. The rib 177 is positioned in the upper vertical half of the flange 176. Such positioning of the rib 177, in combination with the rectangular shape of the flange 176 ensures that the post 134 will only fit in the pocket 178 of the shield frame 120 one way. Such shaping of elements and orientation features allow for facile assembly of the pivot assembly 106. However, it should be understood that some embodiments of the pivot assembly 106 do not include any such rib or other orientation feature between the post 134 and the shield frame 120. In addition, in some embodiments, as shown in FIGS. 1-6, the outer surface of the flange 176 is smooth and flat, such that the pivot assembly 106 is flush or recessed with respect to the outer surface of the headgear 100.

The post 134 further includes a second annular flange 180 (see FIGS. 4 and 6) spaced a short distance behind the flange 176 that extends radially outwardly from the shaft 174. The annular flange 180 has a chamfered outer diameter that tapers rearwardly (i.e., in the direction opposite the flange 176). The annular flange 180 is shaped and sized to fit through an aperture 182 (see FIG. 3) formed in the rear of the pocket 178 of the shield frame 120. Particularly, the rear portion of the annular flange 180 is similar in size or smaller than the inner diameter of the aperture 182 of the shield frame 120 to allow the rear portion of the annular flange 180 to easily fit through the aperture 182, and the front portion of the annular flange 180 is slightly larger than the inner diameter of the aperture 182, such that the post 134 is at least somewhat inhibited from being removed from the shield frame 120. The forward end of the annular flange 180 (i.e., the portion forming the largest outer diameter of the annular flange 180) is rounded to allow the post 134 to be removed from the shield frame 120 when sufficient force is applied to allow for an annular snap-fit-type engagement between the annular flange 180 of the post 134 and the rear aperture 182 of the shield frame 120. It should be understood, however, that other suitable means of coupling the post 134 to the shield 104 can be used, and that some embodiments do not include such coupling features between the post 134 and the shield 104. In such embodiments, the post 134 can be secured to the shield 104, for example, by securing the pivot assembly 106 in an assembled state.

The rear portion 172 of the post 134 includes a rear surface 184 and one or more engagement features 186 that form at least a portion of the rear surface 184, and which are configured to engage the engagement features 166 of the socket 132. In the illustrated embodiment, the post 134 includes five equally-spaced, protrusions that are arranged circumferentially about the shaft 174. In this exemplary embodiment, each protrusion has a generally frusto-sector shape, with arcuate top and bottom surfaces, and is shaped and dimensioned to be received in the recessed engagement features 166 of the socket 132. One of the socket engagement features 166 and the post engagement features 186 can be larger than the other to allow the socket 132 and the post 134 to rotate relative to one another without substantial friction or difficulty. In the illustrated embodiment, the socket engagement features 166 are larger than the post engagement features 186 in diameter and depth but the same in other dimensions to allow facile relative rotational movement, while maintaining integrity in the detent positions provided by the engagement of the socket engagement features 166 and the post engagement features 186.

The socket engagement features 166 of the illustrated embodiment are described herein as "recesses," and the post engagement features 186 are described as "protrusions" that are received in the recessed socket engagement features 166. However, it should be understood that the raised areas on the socket 132 between the recesses can instead be referred to as the socket engagement features 166, such that the illustrated socket engagement features 166 are referred to as "protrusions." Similarly, it should be understood that the recessed areas between the protrusions on the rear portion 172 of the post 134 can instead be referred to as the post engagement features 186, such that the illustrated post engagement features 186 are referred to as "recesses." Thus, one of ordinary skill in the art should understand that the terms "protrusions" and "recesses" are used by way of example only to describe the relative engagement between the socket 132 and the post 134, and are not intended to be limiting.

In addition, to further improve the relative rotation of the socket 132 and the post 134, one or both of the socket engagement features 166 and the post engagement features 186 can include chamfered surfaces to allow the engagement features 166, 186 to cam into and out of engagement with one another as the socket 132 and post 134 are rotated with respect to one another. By way of example only, in the embodiment illustrated in FIGS. 1-6, and as clearly shown in FIGS. 5 and 6, each of the radially-extending walls of the socket engagement features 166 and the post engagement features 186 is chamfered to allow the socket 132 and the post 134 to rotate with respect to one another without undue force.

In some embodiments, as shown in FIGS. 5 and 6, the pivot assembly 106 can include a longitudinal axis B that runs through the center of the pivot assembly 106. The socket engagement features 166 and the post engagement features 186 can be arranged such that the socket engagement features 166 and the post engagement features 186 each have mirror symmetry over the longitudinal axis B. In addition, the spring 136 has mirror symmetry over the longitudinal axis B. Such mirror, or axial, symmetry can allow for common parts. That is, the same socket 132, post 134, and spring 136 (and pivot assembly 106) can be used on either the left side or the right side of the headgear 100. In addition, in some embodiments, such as the illustrated embodiment, one or both of the socket engagement features 166 and the post engagement features 186 can include one or more lines of rotational symmetry. For example the illustrated socket engagement features 166 are rotationally symmetric about the axis A of rotation, and the illustrated post engagement features 186 are rotationally symmetric about the axis A.

The socket engagement features 166 and the post engagement features 186 are shown by way of example only, but it should be understood that a variety of different engagement features can be employed without departing from the spirit and scope of the present invention. For example, a different number of engagement features 166, 186 can be used, the number of socket engagement features 166 does not have to equal the number of post engagement features 186, other shapes of engagement features can be employed, the engagement features can include more or fewer lines of symmetry, other relative sizes can be employed (e.g., the relative size between one socket engagement feature 166 and one post engagement feature 186), and other detent and cam features can be employed to accomplish the metered, relative rotational movement.

As shown in FIGS. 2 and 4, at least a portion of the post 134 is dimensioned to be received in the second aperture 152 of the housing 130 to access the socket 132. That is, the post 134 can be coupled to the housing 130 by moving at least a portion of the post 134 into the second aperture 152 along the second direction $D_2$. The post 134 can be secured to the socket 132 and the housing 130 with the spring 136, which is described in greater detail below.

The socket 132 and the post 134 can be formed of a variety of materials that provide the desired level of rigidity and dimensional stability to ensure proper cooperation and engagement between the socket 132 and the post 134. The socket 132 and the post 134 can be formed of the same or different materials. Examples of suitable socket and/or post materials can include, but are not limited to, at least one of metal (e.g., stainless steel, zinc, aluminum, etc.), polymeric materials (e.g., acetal, polypropylene, polyethylene, etc.), and combinations thereof.

The spring 136 is shaped and dimensioned to be received in the interior 138 of the housing 130 via the bottom slot 150 in the housing 130, for example, by moving the spring 136 into the housing 130 along the first direction $D_1$. The spring 136, shown in the embodiment illustrated in FIGS. 1-6 by way of example only, is a leaf spring that is generally U-shaped, such that the spring 136 includes a base 185, two prongs 187 that extend upwardly from the base 185, two inner edges 188 and two outer edges 189. The inner edges 188 form the inner curve of the "U" and are dimensioned to receive and abut the cylindrical shaft 174 of the post 134. The outer edges 189 can be substantially straight and parallel to the side wall 146 of the housing when the spring 136 is positioned within the housing 130. In the illustrated embodiment, when the spring 136 is inserted into the housing 130, the two prongs 187 of the spring 136 each move along either side of the shaft 174 of the post 134.

The rear portion 172 of the post 134 that is dimensioned to be received in the second aperture 152 to engage the socket 132 further includes a rear annular flange 190 that extends radially outwardly from the shaft 174. The rear portion of the annular flange 190 forms the rear surface 184 of the post 134. The prongs 187 of the spring 136 are spaced a distance apart that is less than the outer diameter of the rear annular flange 190, such that the prongs 187 engage the rear annular flange 190 of the post 134. The prongs 187 of the spring 136 can include a curved cross-sectional shape (see FIG. 4), to provide a biasing force against the rear annular flange 190 of the post 134 generally in the second direction $D_2$. The curved cross-sectional shape is shown in the illustrated embodiment by way of example only, but other suitable cross-sectional shapes can be employed to provide the biasing force. As a result, the biasing force holds the rear portion 172 of the post 134 in the housing 130 and biases the post engagement features 186 into engagement with the socket engagement features 166. The spring 136 can further include a desired amount of flex to allow the post 134 to rotate with respect to the socket 132, and to allow the post engagement features 186 to move into and out of engagement with the socket engagement features 166 as the post 134 and socket 132 are rotated with respect to one another. Particularly, the spring 136 stores the force necessary to provide a desired amount of resistance for moving the shield 104 with respect to the headtop 102 between the open and closed positions 105, 107, such that the shield 104 can be maintained in either the open position 105, the closed position 107, or intermediately thereof, as desired.

The base 185 of the spring 136 can include a first tab 192 that is oriented at an angle (e.g., about 90 degrees, see FIG. 4) with respect to the main body 194 of the base 185, and which is dimensioned to fit over the portion of the front wall 142 of the housing 130 that forms the bottom slot 150. Additionally or alternatively, the spring 136 can include a second tab 196 that is positioned intermediately of the two prongs 187. The second tab 196 is oriented at an angle (e.g., about 90 degrees, see FIG. 4) with respect to the main body 194 of the base 185, and is dimensioned to fit over a bottom portion of the second aperture 152 of the housing 130 (see FIGS. 4 and 5). The stored force in the spring 136 can further bias the base 185 of the spring 136 toward the front wall 142 of the housing 130 generally in a fourth direction $D_4$ to bias the first and/or second tabs 192, 196 into engagement with the housing 130. As shown in FIGS. 4-6, the fourth direction $D_4$ is oriented substantially opposite the second direction $D_2$.

As a result, the spring 136 can be configured to have the additional function of locking the pivot assembly 106 in an assembled state (see FIGS. 2 and 4), and the base 185 of the spring 136 can function as a disassembly feature for the pivot assembly 106. For example, when the pivot assembly 106 is in its assembled state, the base 185 of the spring 136 can be pressed rearwardly toward the headtop 102 (i.e., substantially in the second direction $D_2$, toward the right-hand side of FIG. 4) to release the first and second tabs 192 and 196 from engagement with the housing 130. Simultaneously, the spring 136 can be pulled downwardly out of the housing 130 in a third direction $D_3$, which is oriented substantially opposite the first direction $D_1$, to remove the spring 136 from the housing 130.

In some embodiments, as shown in the illustrated exemplary embodiment, the spring 136 engages with the housing 130 and the post 134 to provide the necessary biasing force for maintaining: (i) the socket 132 toward the rear wall 144 of the housing 130, (ii) the protrusion 160 of the socket 132 into engagement with the recess 162 on the rear wall of the housing 130, (iii) the post engagement features 186 into engagement with the socket engagement features 166, and (iv) the base 185 of the spring 136 into engagement with the housing 130 to inhibit (i) the socket 132 from being removed from the housing 130 via the bottom slot 150, (ii) the post 134 from being removed from housing 130 via the second aperture 152, and (iii) the spring 136 from being removed from the housing 130 until sufficient disassembly force is applied to the base 185 of the spring 136, all while allowing the post 134 (i.e., the shield 104) and the socket 132 (i.e., the headtop 102) to be rotated relative to one another when sufficient torque is applied to the post 134 (or the socket 132) to overcome the biasing force in the spring 136 to, in turn, move the post engagement features 186 out of engagement with the socket engagement features 166.

The spring 136 therefore functions to bias the post 134 and the socket 132 together, and can also function to lock the pivot assembly 106 in an assembled state. As such, the pivot assembly 106 is adapted for facile assembly and disassembly, and does not require the use of any external tools. In addition, each of the components of the illustrated pivot assembly 106 is common to the left or right side of the headgear 100, such that parts can be replaced individually. As described above, some embodiments of the pivot assembly 106 provide one or more orientation features between adjoining components, such that the components can be assembled in only one orientation. Furthermore, the spring 136 can consistently provide the sufficient biasing and holding forces to allow the necessary relative rotation between the shield 104 and the headtop 102, without requiring adjustments to maintain the pivot assembly 106 in an assembled state.

The spring 136 can be formed of a variety of materials that have dimensional stability, and which have, or can be adapted to have, the necessary spring constant. Examples of suitable spring materials can include, but are not limited to, at least one of metal (e.g., carbon steel, stainless steel, clock spring steel, beryllium-copper, etc.), polymeric materials (e.g., acetal, polycarbonate, etc.), elastomeric materials (e.g., urethanes, synthetic or natural rubbers, etc.), and combinations thereof.

In use, the headgear 100 can be assembled by coupling the upper portions 128 of the shield frame 120 to the recesses 114 in the headtop 102 with the pivot assembly 106. For simplicity, only one side of the headgear 100 will be explained in detail, but it should be understood that the same description can be applied to both sides of the headgear 100, and that both sides can be coupled simultaneously or sequentially. The following exemplary coupling and decoupling procedures will be described with respect to one illustrated embodiment; however, it should be understood that some steps may not be necessary for all embodiments of the present disclosure.

The socket 132 can be moved along the first direction $D_1$ into the interior 138 of the housing 130. As the socket 132 is moved along the first direction $D_1$, the outwardly-projecting protrusion 158 cams along the inner surface 148 of the housing 130, and the thin wall 155 is flexed until the protrusion 158 snaps into engagement with the recess 159 in the side wall 146 of the housing 130 (or, in the case of no recess 159, until the socket 132 forms an interference fit with the inner surface 148 of the housing 130). In addition, the rearwardly-projecting protrusion 160 of the socket 132 is positioned within the recess 162 on the rear wall 144 of the housing 130 as the socket 132 is positioned within the housing 130. The post 134 can be coupled to the upper portion 128 of the shield frame 120 by being moved in the second direction $D_2$ until the flange 176 and orientation rib 177 are received in the pocket 178 of the shield frame 120 and the rear portion 172 of the post 134 is received through the rear aperture 182 at the back of the pocket 178. The rear portion 172 of the post 134 can then be coupled to the socket 132 by moving the upper portion 128 of the shield frame 120 and the post 134 generally along the second direction $D_2$ until the rear portion 172 of the post 134 is received through the second aperture 152 of the housing 130 and the post engagement features 186 are positioned at least partially in engagement with the socket engagement features 166. In some embodiments, the post 134 can first be coupled to the shield frame 120, and then the post 134 and the shield frame 120 can be coupled to the housing 130. Alternatively, in some embodiments, the upper portion 128 of the shield frame 120 can first be positioned in the recess 114 of the headtop 102, and then the post 134 can be coupled to the shield frame 120 and the housing 130 simultaneously.

The spring 136 can then be moved in the first direction $D_1$ into the bottom slot 150 of the housing 130, and the two prongs 187 can be slid along the cylindrical shaft 174 of the post 134 to engage the rear annular flange 190 of the post 134. The spring 136 can be moved in the first direction $D_1$ until the spring 136 abuts the cylindrical shaft 174 of the post 134 and/or the first and second tabs 192, 196 of the spring 136 engage the front wall 142 of the housing 130. The shield 104 can then be rotated relative to the headtop 102 by overcoming the resistance of the spring 136 to move the post engagement features 186 out of engagement with the socket engagement features 166.

The shield 104 can be removed from the headtop 102 by disassembling the pivot assembly 106, and decoupling the upper portion 128 of the shield frame 120 from the recesses 114 in the headtop 102, which can occur simultaneously or sequentially. The base 185 of the spring 136 can be pressed rearwardly (i.e., toward the rear wall 144 of the housing 130, generally in the second direction $D_2$) and downwardly in the third direction $D_3$ to remove the spring 136 from the interior 138 of the housing 130. As the spring 136 is removed from the housing 130, the prongs 187 are slid out of engagement with the rear annular flange 190 of the post 134, and the post 134 is no longer biased into contact with the socket 132. As a result, the post 134 can be removed by moving the post 134 out of the second aperture 152 of the housing 130 along the fourth direction $D_4$, which is substantially opposite the second direction $D_2$. As the post 134 is removed from the housing 130, the post 134 can also be removed from the pocket 178 of the shield frame 120, allowing the shield frame 120 to be decoupled from the headtop 102. Alternatively, the shield frame 120 and post 134 can be decoupled from headtop 102 together, and the post 134 can then be removed from the shield frame 120. The socket 132 can be removed from the interior 138 of the housing 130 by moving the socket 132 in the third direction out of the bottom slot 150 of the housing 130. As the socket 132 is removed from the housing 130, the outwardly-projecting protrusion 158 can be decoupled from the recess 159 in the side wall 146 of the housing 130, and the rearward protrusion 160 of the socket 132 can be decoupled from the recess 162 in the rear wall 144 of the housing 130.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. Various features and aspects of the invention are set forth in the following claims.

What is claimed is:

1. A pivot assembly for headgear, the headgear comprising a headtop and a shield, the pivot assembly comprising:

a housing adapted to be coupled to the headtop, the housing including an interior, a first aperture positioned to provide access to the interior along a first direction, and a second aperture positioned to provide access to the interior of the housing along a second direction, the second direction being oriented at an angle with respect to the first direction;

a socket dimensioned to be received in the interior of the housing via the first aperture, the socket including a plurality of first engagement features;

a post adapted to be coupled to the shield, the post including a plurality of second engagement features adapted to engage the plurality of first engagement features, at least a portion of the post dimensioned to be received in the interior of the housing via the second aperture; and a spring dimensioned to be received in the interior via the first aperture of the housing to engage the post, the spring configured to provide a biasing force substantially along the second direction to bias the second plurality of engagement features into engagement with the first plurality of engagement features while allowing relative rotation between the post and the socket.

2. The pivot assembly of claim 1, wherein the spring is further biased to engage at least a portion of the housing to reversibly lock the pivot assembly in an assembled state.

3. The pivot assembly of claim 2, wherein at least a portion of the spring functions as a disassembly feature of the pivot assembly, such that when sufficient force is applied to the disassembly feature to overcome the bias of the spring, the spring can be disengaged from the housing, and the pivot assembly can be disassembled.

4. The pivot assembly of claim 1, wherein the plurality of first engagement features and the plurality of second engagement features have mirror symmetry about a longitudinal axis of the socket and the post, respectively.

5. The pivot assembly of claim 1, wherein the pivot assembly includes an axis of rotation, and wherein the plurality of first engagement features and the plurality of second engagement features have rotational symmetry about the axis of rotation.

6. The pivot assembly of claim 1, wherein the first aperture of the housing has a generally rectangular cross-sectional shape in the first direction, and wherein the second aperture of the housing has a generally circular cross-sectional shape in the second direction.

7. The pivot assembly of claim 1, wherein the second direction is oriented substantially perpendicularly with respect to the first direction.

8. The pivot assembly of claim 1, wherein the shield comprises a shield frame, and wherein the post is adapted to be coupled to one side of the shield frame.

9. The pivot assembly of claim 1, wherein the pivot assembly includes an axis of rotation, wherein the socket includes at least one of a protrusion and a recess oriented along the axis of rotation, and wherein the post includes at least one of a recess and a protrusion, respectively, oriented along the axis of rotation that is adapted to be coupled to the at least one of a protrusion and a recess of the socket.

10. The pivot assembly of claim 1, wherein the socket includes at least one of a shaft and a bore, and the post includes at least one of a bore and a shaft, respectively, that is adapted to be coupled to the at least one of a shaft and a bore of the socket.

11. The pivot assembly of claim 1, wherein the post can only be coupled to the shield in one orientation, and the socket can only be coupled to the housing in one orientation.

12. The pivot assembly of claim 1, wherein at least one of the plurality of first engagement features and the plurality of second engagement features include at least one cam surface configured to allow relative rotational movement between the socket and the post.

13. The pivot assembly of claim 1, wherein the housing is provided by the headtop.

14. The pivot assembly of claim 1, wherein the housing is integrally formed with the headtop.

15. The pivot assembly of claim 1, wherein the spring is a leaf spring.

16. The pivot assembly of claim 1, wherein the socket includes a locating feature, and the housing includes a corresponding feature, and wherein the spring further biases the locating feature of the socket into engagement with the corresponding feature in the housing.

17. The pivot assembly of claim 1, wherein the post includes an orientation feature that is adapted to be coupled to a corresponding feature on the shield, such that the post can only be coupled to the shield in one orientation.

18. The pivot assembly of claim 1, wherein the socket includes an orientation feature that is adapted to be coupled to a corresponding feature on the housing, such that the socket can only be coupled to the housing in one orientation.

19. The pivot assembly of claim 1, wherein at least the socket, the post, and the spring are common to left and right sides of a headgear.

20. A headgear comprising:

a headtop;

a shield; and a pivot assembly adapted to couple the headtop and the shield, such that the shield is pivotally movable relative to the headtop between an open position and a closed position, the pivot assembly comprising:

a housing coupled to the headtop, the housing comprising an interior, a first aperture positioned to provide access to the interior along a first direction, and a second aperture positioned to provide access to the interior of the housing along a second direction, the second direction being different from the first direction, a socket dimensioned to be removably received within the interior of the housing via the first aperture of the housing, the socket having a plurality of first engagement features, a post coupled to the shield, the post having a plurality of second engagement features adapted to engage the plurality of first engagement features of the socket, wherein at least a portion of the post is dimensioned to be removably received in the interior of the housing via the second aperture of the housing, and a spring dimensioned to be removably received within the interior of the housing via the first aperture of the housing, the spring adapted to:

engage the post, bias the plurality of second engagement features into engagement with the plurality of first engagement features, and engage the housing to reversibly lock the pivot assembly in an assembled state.

* * * * *